US009551301B2

(12) United States Patent
Saito et al.

(10) Patent No.: US 9,551,301 B2
(45) Date of Patent: Jan. 24, 2017

(54) ROTARY-TYPE CARBURETOR

(71) Applicant: YAMABIKO CORPORATION, Ohme-shi (JP)

(72) Inventors: Tamotsu Saito, Morioka (JP); Tomoyoshi Kudo, Hachimantai (JP)

(73) Assignee: YAMABIKO CORPORATION, Ohme-Shi, Tokyo (JP)

( * ) Notice: Subject to any disclaimer, the term of this patent is extended or adjusted under 35 U.S.C. 154(b) by 112 days.

(21) Appl. No.: 14/631,196

(22) Filed: Feb. 25, 2015

(65) Prior Publication Data

US 2015/0240747 A1 Aug. 27, 2015

(30) Foreign Application Priority Data

Feb. 27, 2014 (JP) ..... 2014-036521

(51) Int. Cl.
*F02M 9/08* (2006.01)

(52) U.S. Cl.
CPC ..... *F02M 9/085* (2013.01)

(58) Field of Classification Search
CPC ..... B01F 3/04; F02M 9/08; F02M 9/085
USPC ..... 261/35, 34.1, 44.2, 44.6, 44.8, DIG. 38,261/DIG. 39
See application file for complete search history.

(56) References Cited

U.S. PATENT DOCUMENTS 4,481,152 A * 11/1984 Kobayashi ..... F02M 9/085 261/35

FOREIGN PATENT DOCUMENTS

JP 61-183453 S 11/1986
JP 2001-182620 A 7/2001

* cited by examiner

*Primary Examiner* — Robert A Hopkins
(74) *Attorney, Agent, or Firm* — Baker & Hostetler LLP

(57) ABSTRACT

A rotary-type carburetor (1) according to the present invention includes a body (4) having a bore (2) with a circular cross section, and a valve element (6) to be contained in the bore (2). The valve element (6) rotates between a closed position where the valve passage (16) is blocked from communicating with the body passages (10*a*, 10*b*), and a fully-opened position where the valve passage (16) and the body passages (10*a*, 10*b*) are aligned. When the valve element (6) is located in an idle position, an air flowing through the body passages (10*a*, 10*b*) and the valve passage (16) is prevented from being flown into the bore end part (12). When the valve element (6) is located in a fully-opened position, a portion of the air flowing from an upstream part (10*a*) of the body passage is bypassed into the upstream communication part (32).

4 Claims, 4 Drawing Sheets

ROTARY-TYPE CARBURETOR

TECHNICAL FIELD

The present invention relates to a rotary-type carburetor used for two-stroke or four-stroke engine and having a rotary throttle valve.

BACKGROUND

A rotary-type carburetor having a rotary throttle valve is often used in mixture passage which supplies a fuel-air mixture to an engine.

The rotary throttle valve in the rotary-type carburetor includes a block-type body having a bore with a circular cross section extending along an axis, and a valve element with a circular cross section to be contained in the bore. The body includes body passages extending from an upstream side to a downstream side so as to extend through the bore, while the valve element includes a valve passage extending through the valve element in a direction across the axis. The valve element is configured to rotate about the axis between a closed position where the valve passage is blocked from communicating with the body passages, and a fully-opened position where the valve passage and the body passages are aligned so as to define a maximum communication area.

The rotary-type carburetor also includes a carburetion nozzle unit disposed along the axis. The carburetion nozzle unit includes a cylindrical needle receiving part extending from a bore end part of the body through the valve element to the valve passage, and a needle extending from the valve element and being inserted into the needle receiving part. The needle receiving part includes a port for ejecting fuel into the valve passage. When the body passages and the valve passage are in communication with each other, fuel ejected from the port and vaporized is mixed with air flowing through the body passages and the valve passage and supplied to the engine (Please refer to the Patent Publications 1 and 2).

The valve element is also configured to move along the axis in a direction where the valve end part moves away from the bore end part when the valve element rotates from the closed position to the fully opened position so that the needle increases an opening area of the port. A small gap is provided between the valve element and the needle receiving part, enabling the rotation and the movement of the valve element.

PRIOR ART DOCUMENT

[Patent Publication 1] Japanese Patent Laid-open Publication No. 2001-182620

[Patent Publication 2] Japanese Utility Model Laid-open Publication No. S61-183453

SUMMARY OF THE INVENTION

Some portions of the fuel ejected from the port are not vaporized due to a negative-pressure state acted on the body passages and the valve passage and a combustion state in the engine, causing a liquid fuel portion. The liquid fuel portion passes through a gap between the valve element and the needle receiving part and is accumulated in the bore end part in the body. When the fuel accumulated in the bore end part is ejected at one time through the gap to the valve passage due to a negative pressure caused by intake to the engine, a fuel concentration in the body passages increases and affects an engine rotational speed. For example, in a case of a high-speed operation range including a full-throttle operation, the rotational speed of the engine temporarily reduced, and the operation of the engine becomes unstable. The Patent Publications 1 and 2 disclose rotary-type carburetors which improve a stability of the operation of the engine in a low-speed operation range. However, neither the Patent Publications 1 nor 2 disclose a stability of the operation of the engine in the high-speed operation range.

Accordingly, an object of the present invention is to provide a rotary-type carburetor which can improve a stability of an operation of an engine in a high-speed operation range including a full-throttle operation.

In order to achieve the above-stated object, a rotary-type carburetor according to the present invention comprises a block-type body having a bore with a circular cross section extending along an axis; a valve element with a circular cross section to be contained in the bore; and a carburetion nozzle unit disposed along the axis, wherein the body includes body passages extending from an upstream side to a downstream side so as to extend through the bore, wherein the bore includes a bore end part which is adjacent to the body passages and is closed, wherein the valve element includes a valve passage extending through the valve element in a direction across the axis, and a valve end part which is adjacent to the valve passage and which is capable of fitting to the bore end part, wherein the carburetion nozzle unit includes a cylindrical needle receiving part extending from the bore end part of the body through the valve element to the valve passage, and a needle extending from the valve element and being inserted into the needle receiving part, wherein the needle receiving part includes a port for ejecting fuel into the valve passage, wherein the valve element is configured to rotate about the axis between a closed position where the valve passage is blocked from communicating with the body passages, and a fully-opened position where the valve passage and the body passages are aligned so as to define the maximum communication area, wherein the valve element is configured so that when the valve element rotates from the closed position to the fully-opened position, the valve end part moves along the axis in a direction away from the bore end part, causing the needle to increase an opening area of the port, wherein a gap is provided between the valve element and the needle receiving part, enabling the rotation and the movement of the valve element, wherein the body and the valve element are configured so that when the valve element is located in an idle position between the closed position and the fully-opened position, due to the fitting between the valve end part and the bore end part, air flowing from an upstream body passage is prevented from being flown through a clearance between the valve element and the bore into a space within the bore end part, wherein due to the movement of the valve element, the body and the valve element causes an upstream communication part which communicates the upstream body passage with the space within the bore end part, and when the valve element is located in the fully-opened position, a portion of the air flowing from the upstream body passage is bypassed to the upstream communication part.

In the above-stated rotary-type carburetor, when the valve element is located in the idle position between the closed position and the fully-opened position, the air flowing from the upstream body passage is prevented from being flown through the clearance between the valve end part and the bore end part to the space within the bore end part. Namely, the air flowing from the upstream body passage flows through the valve passage to the downstream body passage, ensuring the designed idle operation. When the valve element is in the fully-opened position, the upstream communication part which communicates the upstream body passage with the space within the bore end part is formed by the movement of the valve element. Then, a portion of the air flowing from the upstream body passage is bypassed into the upstream communication part, and is flown into the space within the bore end part. The pressure in the space within the bore end part increases so that an effect that the liquid portion of the fuel is prevented from being flown into the space within the bore end part can be obtained and/or an effect that the liquid portion of the fuel which is flown into the space within the bore end part is discharged from the space within the bore end part can be obtained. As a result, the liquid portion of the fuel is prevented from being accumulated in the space within the bore end part and being ejected to the valve passage at one time, whereby a stability of the operation of the engine in the high speed operation range including the full throttle operation can be improved.

In an embodiment of the present invention, preferably, when the valve element is located in the fully-opened position, the air which is flown into the space within the bore end part is prevented from being flown out through a clearance between the valve element and the bore to a downstream body passage due to the fitting between the valve end part and the bore end part, and flows through a gap between the valve element and the needle receiving part to the valve passage.

In the above-stated rotary-type carburetor, an effect that the liquid portion of the fuel is prevented from being flown into the space within the bore end part can be especially obtained. Specifically, a portion of the air flowing from the upstream body passage is bypassed into the upstream communication part, and flows into the space within the bore end part. The air which is flown into the space within the bore end part flows through the gap between the valve element and the needle receiving part to the valve passage. Thus, the liquid portion of the fuel is prevented from being flown through the gap between the valve element and the needle receiving part into the space within the bore end part. As a result, the liquid portion of the fuel is prevented from being accumulated in the space within the bore end part and being ejected into the valve passage at one time so that a stability of the operation of the engine can be improved.

In an embodiment of the present invention, preferably, the body and the valve element are configured to cause a downstream communication part which communicates the downstream body passage with the space within the bore end part due to the movement of the valve element, and when the valve element is located in the fully-opened position, the air which is flown into the space within the bore end part flows through the downstream communication part to the downstream body passage. More preferably, the downstream communication part is an opening which is formed between the valve element and the bore at the downstream body passage.

In the above-stated rotary-type carburetor, an effect that the liquid portion of the fuel which is flown into the space within the bore end part is discharged from the space within the bore end part is especially obtained. Specifically, a portion of the air flowing from the upstream body passage is bypassed into the upstream communication part, and flows into the space within the bore end part. The air which is flown into the space within the bore end part flows through the downstream communication part to the downstream body passage. Thus, even if the liquid portion of the fuel flows into the space within the bore end part, the liquid portion of the fuel would be promptly discharged through the downstream communication part. As a result, the liquid portion of the fuel is prevented from being accumulated in the space within the bore end part and being ejected to the valve passage at one time so that a stability of the operation of the engine can be improved.

In the embodiment including the downstream communication part, preferably, the bore end part includes a bottom surface and a cylindrical side surface, and a boundary part between the side surface and the bottom surface is rounded.

In the above-stated carburetor, the air flow reaches the entire space within the bore end part so that an effect that the liquid portion of the fuel is discharged through the downstream communication part can be enhanced.

In the embodiments of the present invention, preferably, the upstream communication part is an opening which is formed between the bore valve element and the bore at the upstream body passage.

As explained above, the rotary-type carburetor according to the present invention can improve a stability of the operation of the engine in a high-speed operation range including the full-throttle operation.

DESCRIPTION OF EMBODIMENTS

Figure 1:
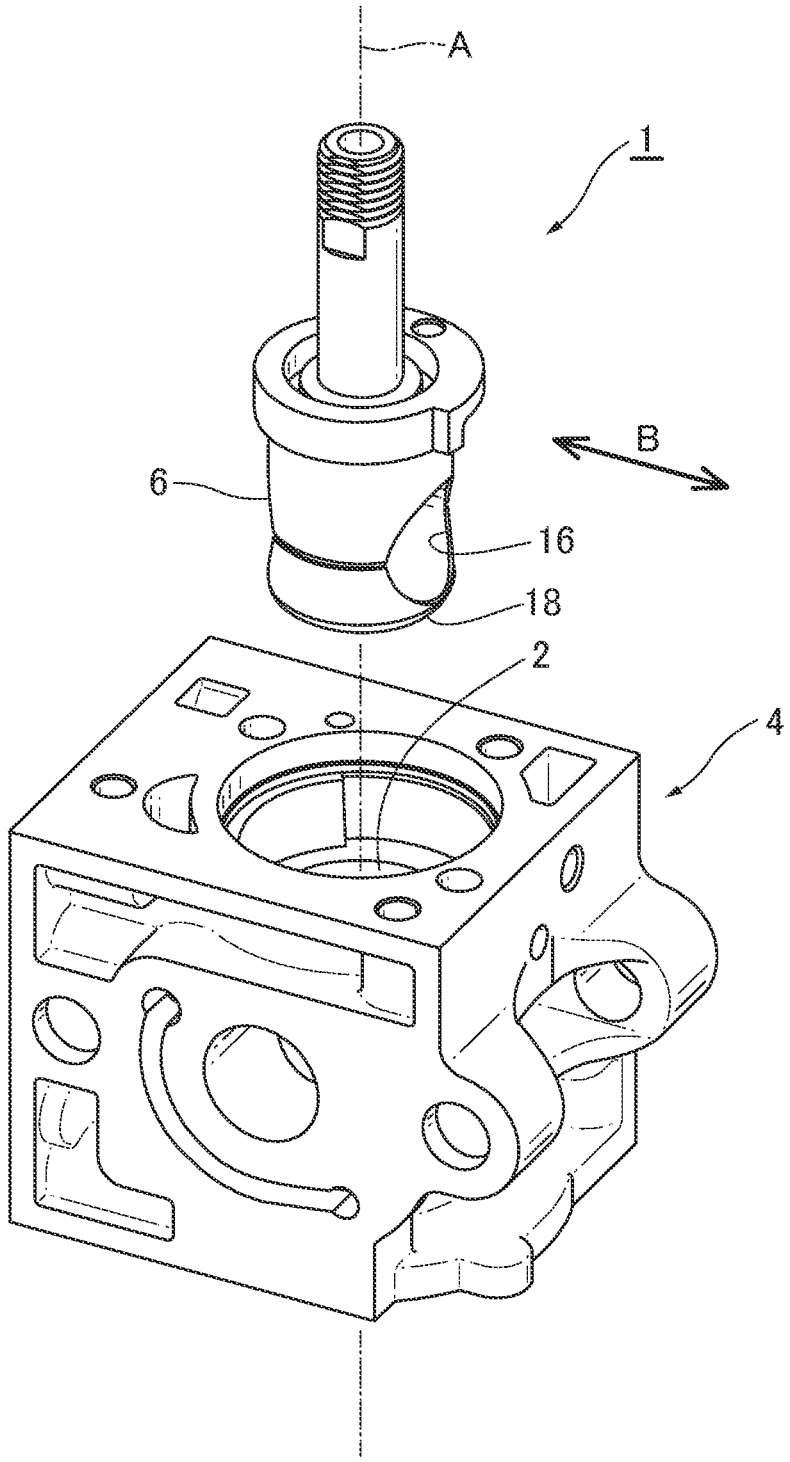
FIG. 1 is an exploded perspective view of a first embodiment of a rotary-type carburetor according to the present invention.

Referring to the drawings, a first embodiment of a rotary-type carburetor according to the present invention will be explained.

As shown in FIG. 1, the rotary-type carburetor 1 according to the first embodiment of the present invention includes a block-type body 4 having a bore 2 with a circular cross section extending along an axis A, and a valve element 6 with a circular cross section so as to be contained in the bore 2. A lid part 8 (shown in FIG. 2) of the body 5 is omitted in FIG. 1.

Figure 2:
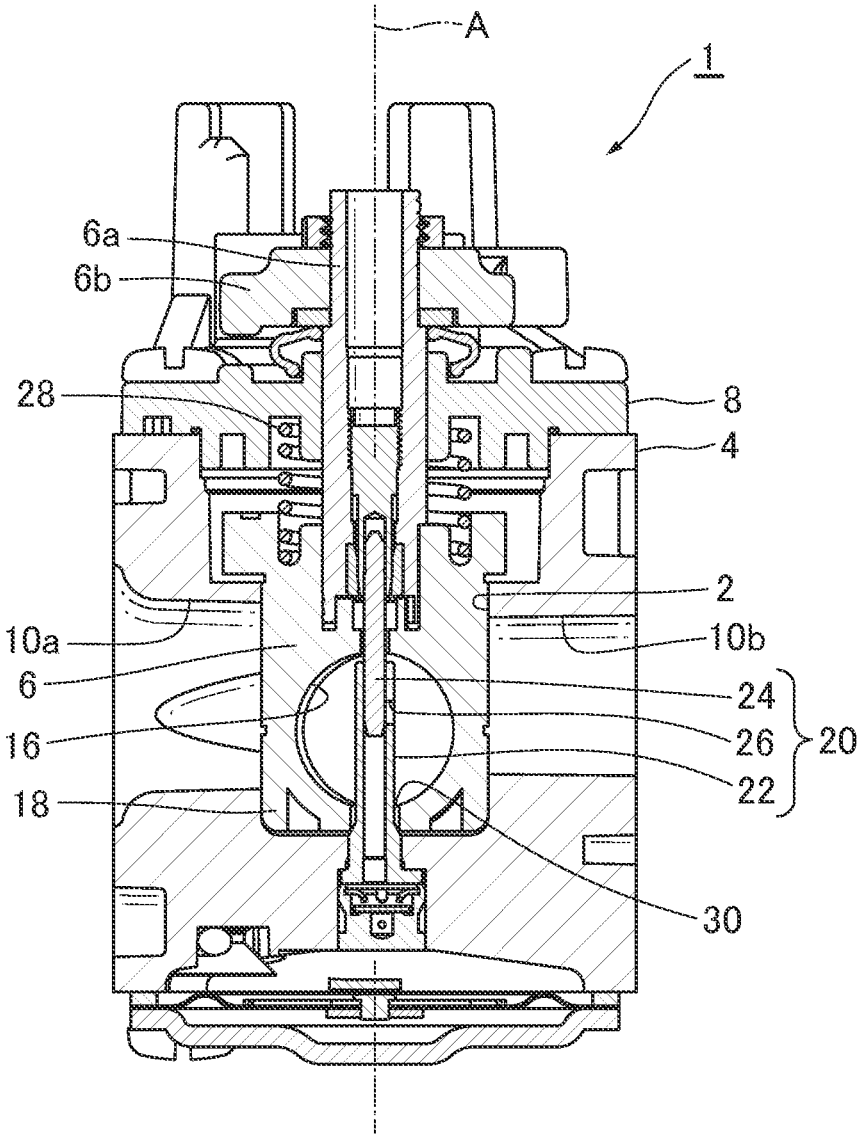
FIG. 2 is a front sectional view of the rotary-type carburetor shown in FIG. 1 at a closed position.
Figure 3:
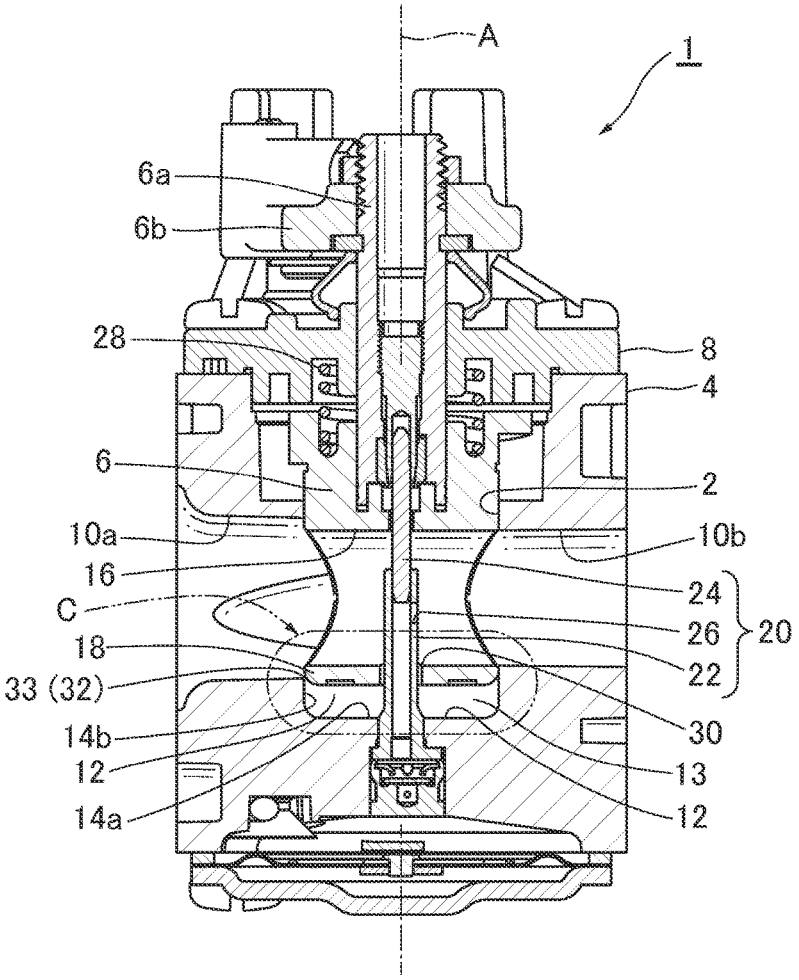
FIG. 3 is a front sectional view of the rotary-type carburetor shown in FIG. 1 at a fully-opened position.

As shown in FIGS. 2 and 3, the body 4 includes body passages 10*a*, 10*b* extending from an upstream side to a downstream side so as to extend through the bore 2. The reference numeral 10*a* indicates the upstream body passage, while the reference numeral 10*b* indicates the downstream body passage. As shown in FIG. 3, the bore 2 includes a bore end part 12 which is adjacent to the body passages 10*a*, 10*b*, and is closed. The bore end part 12 includes a bottom surface 14*a* and a cylindrical side surface 14*b*.

As shown in FIGS. 1 and 3, the valve element 6 includes a valve passage 16 which extends through the valve element 6 in a direction B across the axis A, and a valve end part 18 which is adjacent to the valve passage 16 and is fit into the bore end part 12.

The valve element 6 is configured to rotate about the axis A between a closed position (shown in FIG. 2) where the valve passage 16 is blocked from communicating with the body passages 10*a*, 10*b*, and a fully-opened position (shown in FIG. 3) where the valve passage 16 and the body passages 10*a*, 10*b* are aligned with each other so as to define the maximum communication area. Specifically, as shown in FIG. 2, a valve driving shaft 6*a* extends upwardly from the valve element 6 along the axis A and a lever 6 attached to the valve driving shaft 6*a* is driven by an actuator (not shown) so that the valve element 6 is rotated.

As shown in FIG. 2, the rotary-type carburetor 1 further includes a carburetion nozzle unit 20 disposed along the axis A. The carburetion nozzle unit 20 is of conventional art, as described in the Patent Publication 1.

Explaining briefly, the carburetion nozzle unit 20 includes a cylindrical needle receiving part 22 extending from the body 4 through the valve element 6 into the valve passage 16, and a needle 24 extending from the valve element 6 and being inserted into the needle receiving part 22. The needle receiving unit 22 includes a port 26 through which fuel is ejected into the valve passage 16. The port 26 is formed near a tip of the needle receiving part 22. An opening area of the port 26 is configured to vary by causing the needle 24 to go into and out of the needle receiving unit 22.

The valve element 6 is configured so that when the valve element 6 rotates from the closed position (shown in FIG. 2) to the fully-opened position (shown in FIG. 3), the valve end part 18 moves along the axis A in a direction away from the bore end part 12, causing the needle 24 to increase the opening area of the port 26. The valve element 6 is biased by a spring 28 in a direction of inserting the needle 24 (a direction of decreasing the opening area of the port 26). In response to the rotational position of the valve element 6 (that is, in response to the communication area between the body passages 10*a*, 10*b* and the valve passage 16 according to an opening degree of a throttle valve), a cam (not shown), which urges the needle 24 in a direction of pulling the needle 224 out of the needle receiving part 22 against the spring 28, abuts an upper end part of the valve element 6. FIG. 3 shows a state (a fully opened state) where the needle 24 is pulled most out of the needle receiving part 22.

A gap 30 is provided between the valve element 6 and the needle receiving unit 22, enabling the rotation and the movement of the valve element 6.

When the valve element 6 is in the closed position, the valve end part 18 is fitted into the bore end part 12 over the entire circumference (shown in FIG. 2), and the body 4 and the valve element 6 are configured so that air is not flown into a clearance between the valve end part 18 and the bore end part 12.

For a short period when the valve element 6 rotates from the closed position toward the fully-opened position, the valve end part 18 is fit into the bore end part 12 over the entire circumference. Therefore, when the valve element 6 is in an idle position between the closed position and the fully-opened position, the body 4 and the valve element 6 are configured so that no air is flown into the clearance between the valve end part 18 and the bore end part 12.

Figure 4:
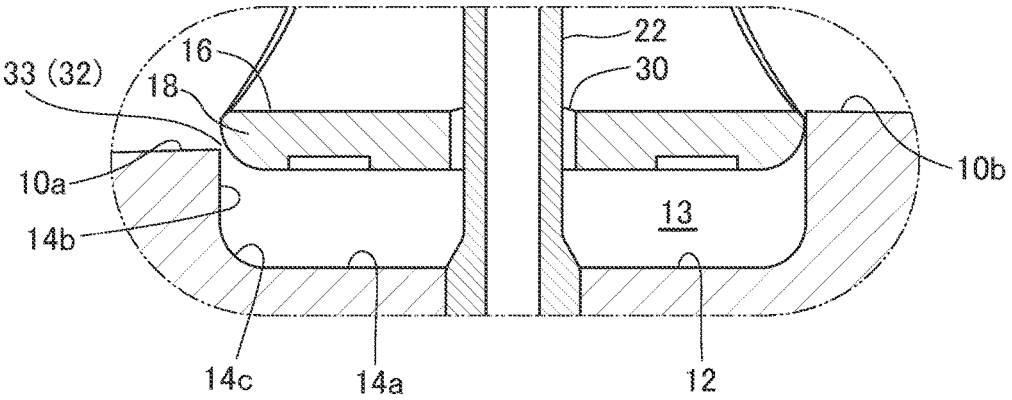
FIG. 4 is a front sectional enlarged view of a portion C (a valve end part and a bore end part) shown in FIG. 3.

As shown in FIGS. 3 and 4, due to the movement of the valve element 6, an upstream communication part 32 which communicates the upstream body passage 10*a* with a space 13 within the bore end part 12 is formed. Specifically, the upstream communication part 32 is an opening 33 which is formed between the bore valve element 6 and the bore 2 in the upstream body passage 10*a*. For example, the opening 33 is formed by rounding an edge of the valve end part 18 and making a diameter of the upstream body passage 10*a* larger than the diameter of the downstream body passage 10*b* (shown in FIG. 4). Consequently, when the valve element 6 is in the fully-opened position, the body 4 and the valve element 6 are provided so that a portion of air flowing from the upstream body passage 10*a* is bypassed into the upstream communication part 32.

A boundary part 14*c* between the side surface 14*b* and the bottom surface 14*a* of the bore end part 12 is rounded.

On the other hand, when the valve element 6 is located in the fully-opened position, air flowing into the space 13 within the bore end part 12 is prevented from being flown through a clearance between the valve element 6 and the bore 2 to the downstream body passage 10*b* due to the fitting between the valve end part 18 and the bore end part 12 (shown in FIG. 4). Thus, the air which is flown into the space 13 within the bore end part 12 flows through the gap 30 between the valve element 6 and the needle receiving part 22 to the valve passage 16.

Then, an operation of the first embodiment of the rotary-type carburetor according to the present invention will be explained.

When the valve element 6 is rotated from the closed position so that the valve element 6 is located in the idle position (not shown), the body passages 10*a*, 10*b* are in communication with the valve passage 16, and air flows into the valve passage 16, causing the engine to rotate in a low speed (shown in FIG. 2). Since the valve end part 18 and the bore end part 12 are fitted to each other over the entire circumference, the air flowing from the upstream body passage 10*a* is prevented from being flown through a clearance between the valve end part 18 and the bore end part 12 into the space 13 within the bore end part 12 to ensure the designed idle operation. If the air flowing from the upstream body passage 10*a* is flown through the clearance between the valve end part 18 and the bore end part 12 into the space 13 within the bore end part 12, the idle operation would become unstable.

When the valve element 6 is located in the fully-opened position (shown in FIGS. 3 and 4), a portion of the air flowing from the upstream body passage 10*a* is bypassed into the upstream communication part 32, and is flown into the space 13 within the bore end part 12. The air which is flown into the space 13 of the bore end part 12 flows through the gap 30 between the valve element 6 and the needle receiving part 22 into the valve passage 16. Namely, the liquid portion of the fuel is prevented from being flown through the gap 30 between the valve element 6 and the needle receiving part 22 into the space 13 within the bore end part 12. Thus, the liquid portion of the fuel is prevented from being accumulated in the space 13 within the bore end part 12 and then being ejected into the valve passage 16 at a once, causing the stability of the operation of the engine to be improved.

Next, a second embodiment of the rotary-type carburetor according to the present invention will be explained. Since the second embodiment differs from the first embodiment only regarding the positional relationship of the valve end part 16 and the bore end part 12 in the fully-opened position of the valve element 6, only the difference between the positional relationships will be explained.

Figure 5:
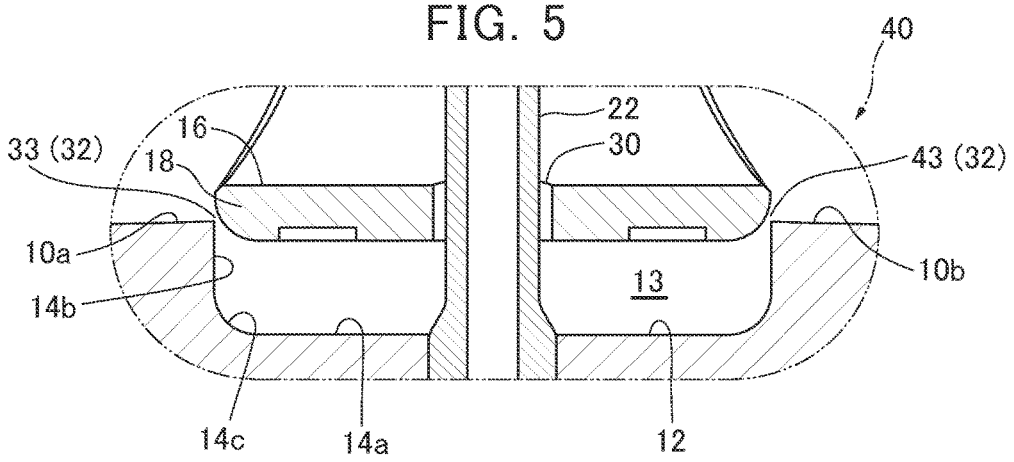
FIG. 5 is a front sectional enlarged view of a valve end part and a bore end part in a second embodiment of a rotary-type carburetor according to the present invention.

As shown in FIG. 5, in the rotary-type carburetor 40 according to the second embodiment of the present invention, the downstream communication part 42 is caused between the downstream body passage 10*b* and the space 13 within the bore end part 12 due to the movement of the valve element 6. Specifically, the downstream communication part 42 is an opening 43 which is formed between valve element 6 and the bore 2 in the downstream body passage 10*b*. For example, the opening 43 is formed by rounding an edge of the valve end part 18 of the valve element 6 and making the diameter of the upstream body passage 10*a* and the diameter of the downstream body passage 10*b* the same as each other. When the valve element 6 is located in the fully-opened position, the air flown into the space 13 within the bore end part 12 is flown through the downstream communication part 42 to the downstream body passage 10*b*. In the fully-opened position, the opening area of the upstream communication part 32 and the opening area of the downstream communication part 42 is preferably almost the same as each other, in order to make the air-inflow into and air-outflow from the space 13 within the bore end part 12 smooth.

Then, an operation of the second embodiment of the rotary-type carburetor according to the present invention will be explained.

A portion of the air flowing from the upstream body passage 10*a* is bypassed into the upstream communication part 32, and flows into the space 13 within the bore end part 12. Then, the air, which is flown into the space 13 within the bore end part 12, flows through the downstream communication part 42 to the downstream body passage 10*b*. As a result, even if the liquid portion of the fuel is flown into the space 13 within the bore end part 12, the liquid portion of the fuel is promptly discharged through the downstream communication part 42. Thus, the liquid portion of the fuel is prevented from being accumulated in the space 13 within the bore end part 12 and being ejected into the valve passage 16 at one time so that a stability of the operation of the engine can be improved.

In the illustrated embodiment, since the edge of the valve end part 18 of the valve element 6 is rounded, the air reaches the corners of the bore end part 12 so that the effect of discharging the liquid portion of the fuel is enhanced.

Next, results of comparative tests between a two-stroke engine using a conventional rotary-type carburetor and other two-stroke engines using the rotary-type carburetors according to the first or second embodiment will be explained.

When these engines are operated in their full-throttle states (at approximately 8,000 rpm), in the engine using the conventional rotary-type carburetor, a decrease in rotational speed (of approximately 50 rpm) was caused every about 30-60 seconds. On the other hand, in the engines using the rotary-type carburetors according to the first or second embodiment, such fluctuations in rotational speed were not caused so that the improvement of the stability in the operation of these engines was confirmed.

Regarding the second embodiment, a comparative test was performed between an engine using the rotary-type carburetor in which the boundary part 14*c* between the side surface 14*b* and the bottom surface 14*a* of the bore end part 12 is rounded, and another engine using the rotary-type carburetor in which the boundary part 14*c* between the side surface 14*b* and the bottom surface 14*a* of the bore end part 12 is not rounded. The fluctuation of the rotational speed tends to less cause in the embodiment of the engine using the rotary-type carburetor with rounded boundary part 14*c* so that a stability of the operation of the engine can be more improved.

Although the embodiments of the present invention have been explained, the present invention is not limited to the above-stated embodiments and various modifications can be made to the claimed invention, which, of cause, fall within the scope of the present invention.

Figure 6:
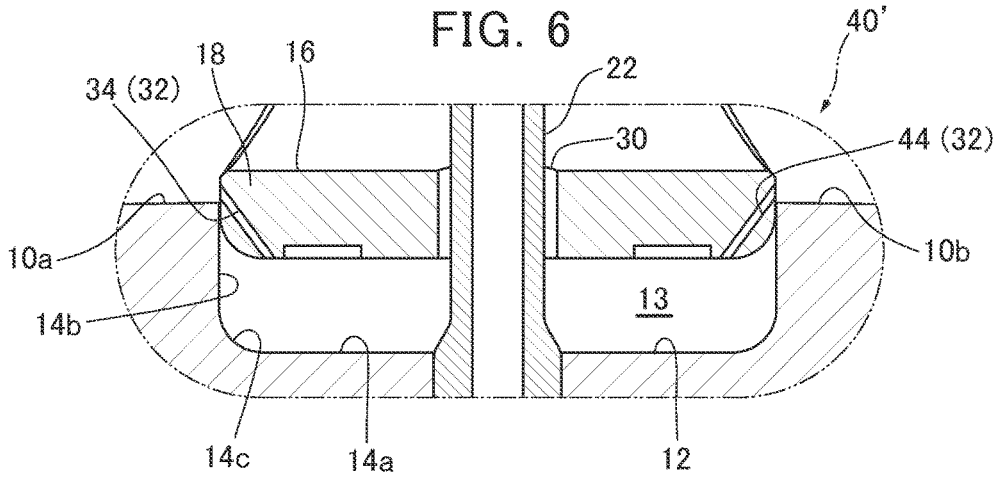
FIG. 6 is a front sectional enlarged view of the valve end part and the bore end part, showing an alternative embodiment of an upstream communication part and a downstream communication part.
Figure 7:
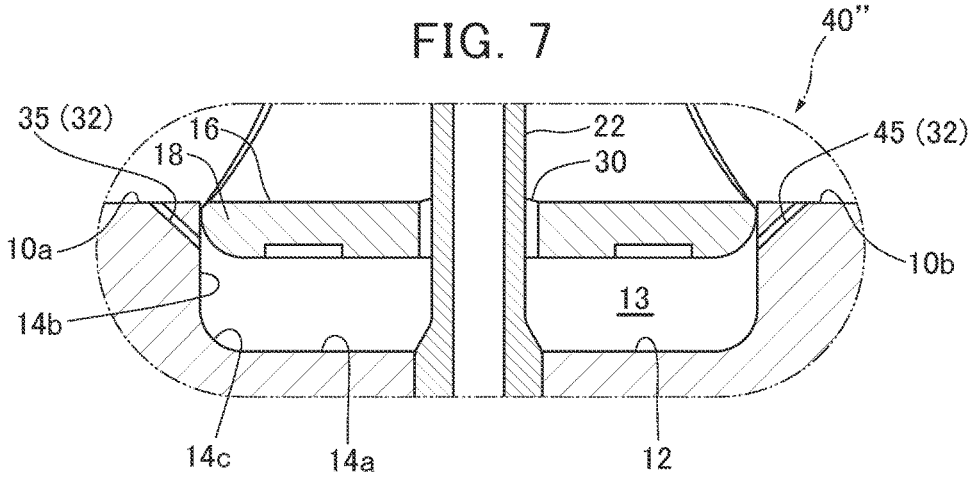
FIG. 7 is a front sectional enlarged view of the valve end part and the bore end part, showing an alternative embodiment of an upstream communication part and a downstream communication part.

In the above-stated embodiments, although the upstream communication part 32 and the downstream communication part 42 are formed by rounding the edge of the valve end part 18 of the valve element 6, any method of forming the upstream communication part 32 and the downstream communication part 42 can be employed. For example, the corner of the bore end part 12 may be chamfered or rounded (not shown). The upstream communication part 32 and/or the downstream communication part 42 may be formed as through passages 34, 44 of the valve element 6 so that when the valve element 6 moves in a direction away from the bottom surface 14*a*, the upstream part 10*a* and/or the downstream body passage 10*b* are/is communicated with the space 13 within the bore end part 12 via the through passages 34, 44 of the valve element 6, as shown in FIG. 6. The upstream communication part 32 and/or the downstream communication part 42 may be also formed as through passages 35, 45 of the body 4 so that when the valve element 6 moves in a direction away from the bottom surface 14*a*, the upstream body passage 10*a* and/or the downstream body passage 10*b* are/is communicated with the space 13 within the bore end part 12 via the through passages 35, 45 of the body 4, as shown in FIG. 7.

The invention claimed is:

1. A rotary-type carburetor, comprising:

a block-type body having a bore with a circular cross section extending along an axis;

a valve element with a circular cross section to be contained in the bore; and a carburetion nozzle unit disposed along the axis, wherein the body includes body passages extending from an upstream side to a downstream side so as to extend through the bore and including an upstream body passage and a downstream body passage, wherein the bore includes a bore end part which is adjacent to the body passages and is closed, wherein the valve element includes a valve passage extending through the valve element in a direction across the axis, and a valve end part which is adjacent to the valve passage and which is capable of fitting into the bore end part, wherein the carburetion nozzle unit includes a cylindrical needle receiving part extending from the bore end part of the body through the valve element to the valve passage, and a needle extending from the valve element and being inserted into the needle receiving part, wherein the needle receiving part includes a port for ejecting fuel into the valve passage, wherein the valve element is configured to rotate about the axis between a closed position where the valve passage is blocked from communicating with the body passages, and a fully-opened position where the valve passage and the body passages are aligned so as to define the maximum communication area, wherein the valve element is configured so that when the valve element rotates from the closed position to the fully-opened position, the valve end part moves along the axis in a direction away from the bore end part, causing the needle to increase an opening area of the port, wherein a gap is provided between the valve element and the needle receiving part, enabling the rotation and the movement of the valve element, wherein the body and the valve element are configured so that when the valve element is located in an idle position between the closed position and the fully-opened position, due to a fitting between the valve end part and the bore end part, air flowing from the upstream body passage is prevented from being flown through a clearance between the valve element and the bore into a space within the bore end part, wherein due to the movement of the valve element, the body and the valve element causes an upstream communication part which communicates the upstream body passage with the space within the bore end part, and when the valve element is located in the fully-opened position, a portion of the air flowing from the upstream body passage is bypassed to the upstream communication part, wherein the body and the valve element are configured to cause a downstream communication part which communicates the downstream body passage with the space within the bore end part due to the movement of the valve element, wherein when the valve element is located in the fully-opened position, the air which is flown into the space within the bore end part flows through the downstream communication part to the downstream body passage; and wherein the bore end part includes a bottom surface and a cylindrical side surface, and a boundary part between the side surface and the bottom surface is rounded.

2. A rotary-type carburetor according to claim 1, wherein when the valve element is located in the fully-opened position, the air which is flown into the space within the bore end part is prevented from being flown out through a clearance between the valve element and the bore to the downstream body passage due to the fitting between the valve end part and the bore end part, and flows through a gap between the valve element and the needle receiving part to the valve passage.

3. A rotary-type carburetor according to claim 1, wherein the downstream communication part is an opening which is formed between the valve element and the bore at the downstream body passage.

4. A rotary-type carburetor according to claim 1, wherein the upstream communication part is an opening, which is formed between the valve element and the bore at the upstream body passage.

* * * * *